US009952547B2

(12) United States Patent
Oyama

(10) Patent No.: US 9,952,547 B2
(45) Date of Patent: Apr. 24, 2018

(54) IMAGE FORMING APPARATUS WITH FUSER AND EJECTION ROLLER TO EJECT SHEET

(71) Applicant: Brother Kogyo Kabushiki Kaisha, Nagoya-shi, Aichi-ken (JP)

(72) Inventor: Yoshihiro Oyama, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/373,180

(22) Filed: Dec. 8, 2016

(65) Prior Publication Data

US 2017/0168435 A1 Jun. 15, 2017

(30) Foreign Application Priority Data

Dec. 10, 2015 (JP) ..... 2015-241412

(51) Int. Cl.
*G03G 15/00* (2006.01)
*G03G 15/20* (2006.01)

(52) U.S. Cl.
CPC ..... *G03G 15/6573* (2013.01); *G03G 15/2039* (2013.01); *G03G 15/6529* (2013.01); *G03G 2215/00945* (2013.01); *G03G 2215/2045* (2013.01)

(58) Field of Classification Search
CPC ..... G03G 15/2028; G03G 15/2085; G03G 15/65; G03G 15/6573; G03G 2215/00371; G03G 2215/00413; G03G 2215/00417; G03G 2215/00421; G03G 2215/00535; G03G 2215/00556; G03G 2215/00945
See application file for complete search history.

(56) References Cited

U.S. PATENT DOCUMENTS 6,134,400 A * 10/2000 Higashi ..... G03G 15/205 219/216
6,137,984 A * 10/2000 Higashi ..... G03G 15/2064 219/216
6,181,891 B1 * 1/2001 Higashi ..... G03G 15/2042 399/69
6,212,356 B1 * 4/2001 Ishikawa ..... G03G 15/2064 399/320
7,806,516 B2 10/2010 Matsuno
(Continued)

FOREIGN PATENT DOCUMENTS

JP H07-191562 A 7/1995
JP 2000-112188 A 4/2000
(Continued)

*Primary Examiner* — Carla Therrien
(74) *Attorney, Agent, or Firm* — Banner & Witcoff, Ltd.

(57) ABSTRACT

An image forming apparatus, including a process unit to form a developer image on a sheet, a fuser to convey the sheet and fix the developer image on the sheet by the process unit, a first roller to convey the sheet exiting the fuser to be ejected outside a body of the image forming apparatus, and a driving unit to drive the first roller, is provided. The driving unit drives the first roller at a circumferential velocity higher than a sheet-conveying velocity to convey the sheet by the fuser. The driving unit increases the circumferential velocity of the first roller to be higher as the sheet-conveying velocity to convey the sheet by the fuser is higher.

18 Claims, 7 Drawing Sheets

(56) References Cited

U.S. PATENT DOCUMENTS

| | | | | |
|---|---|---|---|---|
| 2002/0044802 | A1* | 4/2002 | Tsuruya | G03G 15/6573 399/322 |
| 2006/0051116 | A1* | 3/2006 | Koshida | G03G 15/657 399/68 |
| 2007/0070171 | A1 | 3/2007 | Matsuno | |
| 2007/0147911 | A1* | 6/2007 | Hirota | G03G 15/2028 399/322 |
| 2009/0060548 | A1* | 3/2009 | Souda | G03G 15/6573 399/68 |
| 2010/0052239 | A1* | 3/2010 | Honda | B65H 29/14 271/3.24 |
| 2011/0103855 | A1* | 5/2011 | Morikawa | G03G 15/6573 399/341 |
| 2017/0102654 | A1* | 4/2017 | Umehara | G03G 15/6529 |

FOREIGN PATENT DOCUMENTS

| | | | |
|---|---|---|---|
| JP | 2002-182515 | A | 6/2002 |
| JP | 2007-091374 | A | 4/2007 |
| JP | 2008-225069 | A | 9/2008 |

* cited by examiner

IMAGE FORMING APPARATUS WITH FUSER AND EJECTION ROLLER TO EJECT SHEET

CROSS-REFERENCE TO RELATED APPLICATION

This application claims priority under 35 U.S.C. § 119 from Japanese Patent Application No. 2015-241412, filed on Dec. 10, 2015. The entire subject matter of the application is incorporated herein by reference.

BACKGROUND

Technical Field

The following description is related to an aspect of an image forming apparatus with a fuser and an ejection roller to eject a sheet, and to a method to control the image forming apparatus.

Related Art

An image forming apparatus may be equipped with a processing unit to form an image on a sheet in a developer agent, a fuser to thermally fix the image formed in the processing unit on the sheet, and an ejection roller to eject the sheet conveyed through the fuser outside. The ejection roller may be driven in a higher velocity than a velocity to convey the sheet in the fuser.

SUMMARY

The fuser in the image forming apparatus may include a resiliently deformable roller made of, for example, rubber, to convey the sheet. When images are formed on multiple sheets continuously, the roller in the fuser may accumulate the heat and expand, and a diameter of the roller may increase. When a driving force is input to the expanded roller, the velocity to convey the sheet by the fuser may fluctuate. Therefore, relation between the velocity to convey the sheet by the fuser and a circumferential velocity of the ejection roller may not be maintained constant, and behaviors of the sheets conveyed through the fuser may become unstable.

The present disclosure is advantageous in that an image forming apparatus, in which behaviors of sheets conveyed through a fuser may be stabilized, and a method to control the image forming apparatus are provided.

According to an aspect of the present disclosure, an image forming apparatus, including a process unit to form a developer image on a sheet, a fuser to convey the sheet and fix the developer image formed on the sheet by the process unit, a first roller to convey the sheet exiting the fuser to be ejected outside a body of the image forming apparatus, and a driving unit to drive the first roller, is provided. The driving unit drives the first roller at a circumferential velocity higher than a sheet-conveying velocity of the fuser. The driving unit increases the circumferential velocity of the first roller to be higher as the sheet-conveying velocity of the fuser is higher.

According to another aspect of the present disclosure, a method to control an image forming apparatus, which includes a process unit to form a developer image on a sheet; a fuser to convey the sheet and fix the developer image on the sheet by the process unit thereon; a first roller to convey the sheet exiting the fuser to be ejected outside a body of the image forming apparatus; and a driving unit to drive the first roller, is provided. The method includes controlling the driving unit to drive the first roller at a circumferential velocity higher than a sheet-conveying velocity of the fuser. The driving unit is controlled to increase the circumferential velocity of the first roller to be higher as the sheet-conveying velocity of the fuser is higher.

BRIEF DESCRIPTION OF THE ACCOMPANYING DRAWINGS

DETAILED DESCRIPTION

Figure 1:
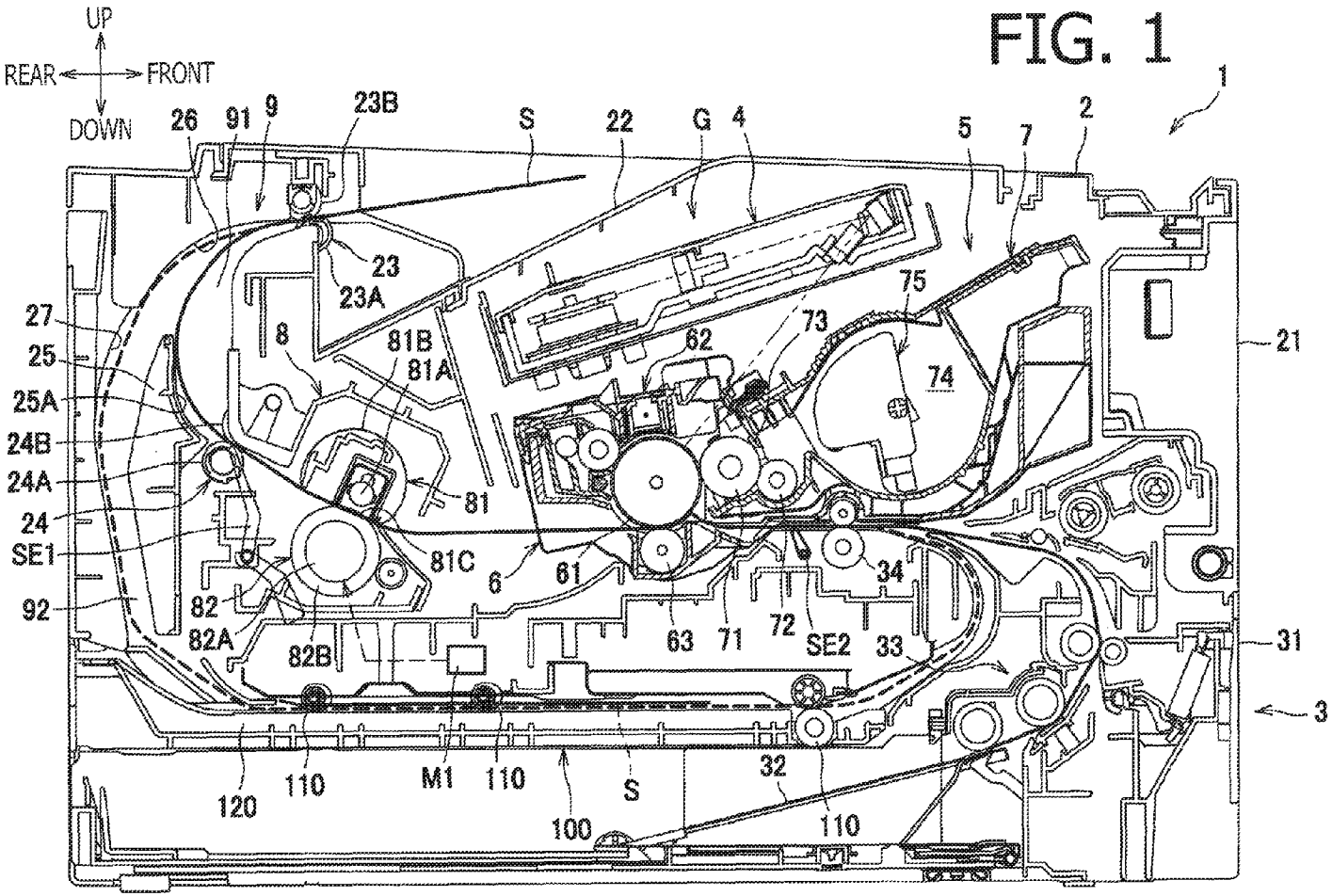
FIG. 1 is an illustrative cross-sectional side view of a laser printer according to an exemplary embodiment of the present disclosure.

Hereinafter, an exemplary configuration of a laser printer 1 being an image forming apparatus according to embodiments of the present disclosure will be described with reference to the accompanying drawings. In the following description, directions related to the laser printer 1 will be cited in accordance with a user's ordinary position to use the laser printer 1, as indicated by arrows in FIGS. 1 and 6. For example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as a left-hand side, and an opposite side from the right, which corresponds to the viewer's farther side is referred to as a right-hand side. An up-to-down or down-to-up direction in FIG. 1 corresponds to a vertical direction of the laser printer 1. A front-to-rear or rear-to-front direction may be referred to as a front-rear direction. A right-to-left or left-to-right direction may be referred to as a widthwise direction.

As shown in FIG. 1, the laser printer 1 includes a main body 2, an image forming unit G to form an image on a sheet S, a sheet feeder 3 to feed the sheet S to the image forming unit G, and a conveyer 9 to convey the sheet S exiting the image forming unit G further. In the following description, a direction to convey the sheet S to and beyond the image forming unit G, through the conveyer 9, to eject the sheet S outside the main body 2, will be referred to as a forward direction. On the other hand, a direction opposite from the forward direction will be referred to as a reverse direction.

The sheet feeder 3 is disposed in a lower position in the main body 2 and includes a feeder tray 31 to contain one or more sheets S, a sheet-pressing plate 32, a feeder device 33, and a registration roller 34.

The registration roller 34 is disposed at a position downstream from the feeder device 33 and upstream from a photosensitive drum 61 in the image forming unit G with regard to a flow in the forward direction. The registration roller 34 may stop a leading end of the sheet S being fed by the feeder device 33 for a brief instant to correct skew in the sheet S and adjust timings to form an image on the sheet S. The registration roller 34 and the photosensitive drum 34 may be driven at an equal circumferential velocity so that the sheet S may be conveyed stably without being loosened or tightened between the registration roller 34 and the photosensitive drum 61.

The sheet feeder 3 may lift the sheets S on the feeder tray 31 upward by the sheet-pressing plate 32 and feed the sheets S one-by-one by the feeder device 33 and the registration roller 34 to the image forming unit G.

The image forming unit G includes an exposure device 4, a process cartridge 5, and a fuser 8.

The exposure device 4 is disposed in an upper position in the main body 2 and includes a laser emitter (not shown), polygon mirrors, lenses, and reflection mirrors, which may be shown but unsigned. In the exposure device 4, a laser beam may be emitted, as illustrated in double-dotted line in FIG. 1, at a surface of the photosensitive drum 61 in the process cartridge 5 via the polygon mirrors, the lenses, and the reflection mirrors so that the surface of the photosensitive drum 61 may be selectively exposed to the laser beam.

The process cartridge 5 may form images on the fed sheet S in a developer agent. The developer agent may be, for example, toner. The process cartridge 5 is disposed in a lower position with respect to the exposure device 4. The process cartridge 5 may be detachably attached to the main body 2 through an opening, which may be exposed when a front cover 21 of the main body 2 is open. The process cartridge 5 includes a drum unit 6 and a developer unit 7. The drum unit 6 includes the photosensitive drum 61, a scorotron charger 62, and a transfer roller 63. The developer unit 7 includes a developer roller 71, a supplier roller 72, and a spreader blade 73, a container 74 to contain positively-chargeable toner being the developer agent, and an agitator 75 to rotate inside the container 74.

In the process cartridge 5, as the photosensitive drum 61 rotates, the surface of the photosensitive drum 61 may be electrically evenly charged by the charger 62 and partly exposed to the laser beam emitted from the exposure device 4 so that the areas exposed to the laser beam may form an electrostatic latent image according to image data, and the electrostatic latent image may be carried on the surface of the photosensitive drum 61. The agitator 75 may rotate in the container 74 to stir the developer agent and conveys the stirred developer agent toward the developer roller 71. The supplier roller 72 arranged to contact the developer roller 71 may rotate along with the developer roller 71 and supply the developer agent discharged out of the container 74 by the agitator 75 to the developer roller 71. The developer roller 71 is arranged to contact the spreader blade 73, and as the developer roller 71 rotates, the spreader blade 73 may flatten the developer agent evenly on a surface of the developer roller 71 so that the developer agent may be carried on the surface of the developer roller 71 in a layer.

Thereafter, in the developer unit 7, the toner carried on the developer roller 71 may be supplied to the electrostatic latent image on the photosensitive drum 61 to visualize the electrostatic latent image and develop an image in the developer agent on the photosensitive drum 61. The sheet S fed by the sheet feeder 3 may be carried to a position between the photosensitive drum 61 and the transfer roller 63 so that the image in the developer agent on the photosensitive drum 61 may be transferred onto the sheet S.

The fuser 8 is disposed in a rearward position with respect to the process cartridge 5 and includes a heat applier 81 and a pressure roller 82, which are arranged to face each other. The heat applier 81 includes a halogen heater 81A, a fuser belt 81B, and a nipper board 81C.

The pressure roller 82 includes a shaft 82A, which extends axially in the widthwise direction, and a roller body 82B, which is rotatable integrally with the shaft 82A about the shaft 82A. The roller body 82B is a resiliently deformable member made of, for example, rubber. An outer surface of the fuser belt 81B and an outer circumferential surface of the roller body 82B face each other. The roller body 82B is arranged to be urged against the nipper board 81C to apply pressure in a deformed condition to nip the fuser belt 81B together with the nipper board 81C. The roller body 82B may be rotated by a driving force from a first motor M1, which is arranged inside the main body 2.

The fuser 8 may convey the sheet S, onto which the image in the developer agent is transferred, through an intermediate position between the heat applier 81 and the pressure roller 82 to thermally fuse and fix the image in the developer agent on the sheet S.

The conveyer 9 may convey the sheet S exiting the fuser 8 to eject the sheet S outside the main body 2 to be placed on an ejection tray 22, which forms an upper part of the main body 2, or to invert the sheet S and direct the inverted sheet S to the process cartridge 5 once again so that another image may be formed on the inverted side of the sheet S. The conveyer 9 includes a conveyer path 91, a return path 92, an ejection roller 23, a guide member 25, a first guide 26, a second guide 27, and a return conveyer unit 100. The conveyer 9 further includes a conveyer roller 24.

The conveyer path 91 is a pathway to guide the sheet S exiting the fuser 8 to be ejected outside, and is arranged in a rearward area in the main body 2. The conveyer path 91 is formed to extend upward from a rearward position with respect to the fuser 8 and to curve frontward.

The return path 92 is a pathway to guide the sheet S exiting the fuser 8 to the process cartridge 5 once again. The return path 92 is formed to branch from the conveyer path 91 to extend downward and curve frontward. The return path 92 extends further frontward from the curve through an area above the feeder tray 31 and curves upward to turn toward a position upstream from the registration roller 34 with regard to the forward direction.

The conveyer roller 24 is disposed at a position between the fuser 8, specifically between a position of the heat applier 81 and the pressure roller 82 and the ejection roller 23, to convey the sheet S exiting the fuser 8. With the conveyer roller 24, the sheet S conveyed by the heat applier 81 and the pressure roller 82 in the fuser 8 may be further conveyed in the conveyer path 91 stably. The conveyer roller 24 includes a first roller 24A, to which a driving force from a driving source, such as the first motor M1, in the main body 2 may be transmitted, and a second roller 24B, which may nip the sheet S in conjunction with the first roller 24A.

The ejection roller 23 is disposed at an exit of the conveyer path 91 in an upper position with respect to the fuser 8. The ejection roller 23 may convey the sheet S exiting the fuser 8 in the forward direction to eject the sheet S outside the main body 2 by rotating in a forward direction and in the reverse direction to return the sheet S to the process cartridge 5 by rotating in a reverse direction. The ejection roller 23 includes a first ejection roller 23A and a second ejection roller 23B, which may together nip the sheet S at an intermediate position in there-between. The first ejection roller 23A is rotatable by a driving force from a driving source, such as a second motor M2 (see FIG. 2), in the main body 2. Detailed configuration to drive the ejection roller 23 will be described later.

The guide member 25 is disposed in a rearward position with respect to the fuser 8 between the conveyer path 91 and the return path 92. The guide member 25 may guide the sheet S conveyed in the conveyer path 91 toward the ejection roller 23 or the sheet S conveyed in the reverse direction by the ejection roller 23 toward the return conveyer unit 100.

Specifically, the guide member 25 includes a guiding face 25A that faces inward, i.e., toward a side, on which the fuser 8 is disposed. The guiding face 25A spreads upper-rearward from a position rearward with respect to the fuser 8 in a range between the fuser 8 and the ejection roller 23. The guiding face 25A is in a cross-sectional shape of an arc, on an inner side of which the heat applier 81 is disposed, in a view along the widthwise direction being an axial direction of the pressure roller 82. In other words, the guiding face 25A is curved outward toward the rear from the side of the heat applier 81A. The guiding face 25A is curved in the arc so that the sheet S exiting the fuser 8 may contact the guiding face 25A on a surface that faces the pressure roller 82 and may be conveyed along the arc to be turned toward the side of the heat applier 81A.

The first guide 26 is a member to guide the sheet S to be conveyed in the conveyer path 91 and is arranged at an upper position with respect to the guide member 25 to be spaced apart from the guide member 25. The first guide 26 extends frontward from the upper position with respect to the guide member 25 to contact and guide the sheet S that is turned by the guiding face 25A from above.

The second guide 27 is a member to guide the sheet S to be conveyed in the return path 92 and is arranged to be spaced apart from the guide member 25 on an opposite side from the fuser 8 across the guide member 25 to extend in the vertical direction. The second guide 27 may contact the sheet S being conveyed by the ejection roller 23 in the reverse direction and guide the sheet S downward.

The return conveyer unit 100 is disposed between the feeder tray 31 and the image forming unit G. The return conveyer unit 100 forms a lower part of the return path 92 and may convey the sheet S conveyed by the ejection roller 23 in the reverse direction to return to the process cartridge 5. The return conveyer unit 100 includes a plurality of return-conveyer rollers 110, which are arranged along the front-rear direction, and a guide plate 120, which extends frontward from a lower position with respect to the second guide 27 to a position below the registration roller 34 to guide the sheet S.

Upon completion of forming the image with the sheet S, the sheet S may be conveyed through the fuser 8 and in the conveyer path 91 by the fuser 8, and further by the ejection roller 23 rotating in the forward direction to be ejected outside the main body 2. The ejected sheet S may be placed on the ejection tray 22. Meanwhile, after completion of forming an image on one side of the sheet S and in order to form another image on the other side of the sheet S, the ejection roller 23 may be rotated in the reverse direction before the sheet S with the image formed on the one side is ejected completely outside the main body 2 so that the sheet S may be drawn back in the main body 2 to be conveyed through the conveyer path 91 and in the return path 92. Thereafter, as indicated in a broken line in FIG. 1, the sheet S may be conveyed in the return path 92 to return to the process cartridge 5.

The sheet S with another image formed on the other side in the process cartridge 5 may be conveyed through the fuser 8 and in the conveyer path 91 to be ejected outside the main body 2 by the ejection roller 23 rotating in the forward direction.

According to the present embodiment, a circumferential velocity of the conveyer roller 24 is higher than a sheet-conveying velocity to convey the sheet S in the fuser 8, in particular, by the heat applier 81 and the pressure roller 82.

Meanwhile, a frictional force to be produced by the conveyer roller 24 with the sheet S is designed to be smaller than a frictional force to be produced by the heat applier 81 and the pressure roller 82 with the sheet S in the fuser 8. In order to reduce an amount of the frictional force between the conveyer roller 24 and the sheet S, the second roller 24B in the conveyer roller 24 may be made of, for example, a resin including polyacetal (POM). Therefore, even with the circumferential velocity of the conveyer roller 24 being higher than the sheet-conveying velocity by the heat applier 81 and the pressure roller 82, the sheet S may be prevented from being pulled too fast by the conveyer roller 24 to slip between the heat applier 81 and the pressure roller 82, and the sheet-conveying velocity in the fuser 8 may be restrained from being fluctuated. Further, due to the velocity difference, the sheet S may be maintained tensed between the fuser 8 and the conveyer roller 24 so that the sheet S may be conveyed stably between the fuser 8 and the conveyer roller 24.

Figure 2:
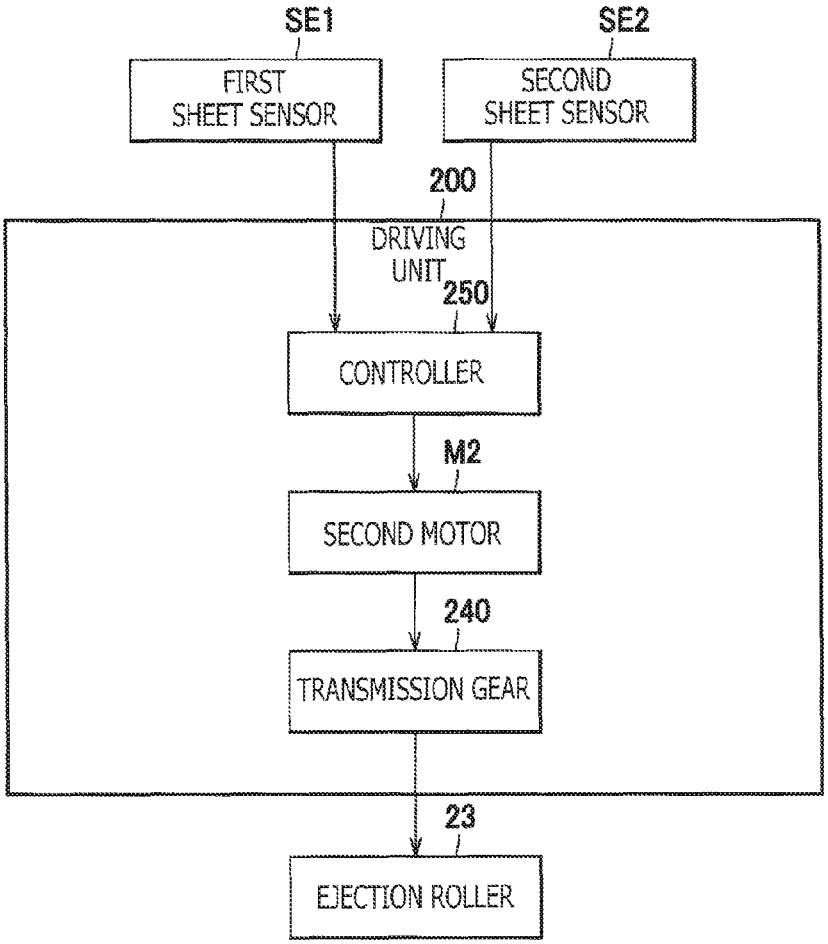
FIG. 2 is a diagram to illustrate a configuration of a driving unit in the laser printer according to the exemplary embodiment of the present disclosure.

As shown in FIG. 2, the laser printer 1 includes a first sheet sensor SE1, a second sheet sensor SE2, and a driving unit 200.

The first sheet sensor SE1 is, as shown in FIG. 1, disposed between the fuser 8, more specifically the intermediate position between the heat applier 81 and the pressure roller 82, and the conveyer roller 24. The second sheet sensor SE2 is disposed between the registration roller 34 and the photosensitive drum 61. The first sheet sensor SE1 and the second sheet sensor SE2 are each in a known configuration to detect the sheet S. For example, the first sheet sensor SE1 and the second sheet sensor SE 2 detecting the sheet S may output signals indicating ON to a controller 250 in the driving unit 200.

The driving unit 200 may drive the ejection roller 23, as shown in FIG. 2, at the higher circumferential velocity than the sheet-conveying velocity to convey the sheet S in the fuser 8 by the heat applier 81 and the pressure roller 82. The driving unit 200 includes the second motor M2, a transmission gear 240, and the controller 250.

The second motor M2 is a driving source separate from the first motor M1. The transmission gear 240 may transmit the driving force from the second motor M2 to the ejection roller 23.

The controller 250 includes a central processing unit (CPU), a read-only memory (ROM), a random access memory (RAM), which are not shown. The controller 250 may control behaviors of the second motor M2 and a switcher device 230 based on a program prepared in advance and the signals output from the first sheet sensor SE1 and the second sensor SE2.

The controller 250 may control the second motor M2 to change the circumferential velocity of the ejection roller 23 when a print job is received.

Specifically, the controller 250 controls the circumferential velocity of the ejection roller to be higher when the sheet-conveying velocity to convey the sheet S by the heat applier 81 and the pressure roller 82 is higher.

According to the embodiment, the controller 250 obtains a sheet-conveying velocity V to convey the sheet S by the heat applier 81 and the pressure roller 82 based on detected results output from the first sheet sensor SE1 to detect a leading end and a trailing end of the sheet S. For example, the controller 250 may determine a length of the sheet S being conveyed based on a duration, in which the second sheet sensor SE 2 outputs the ON signals. The controller 250 includes a timer that may count a duration, in which the first sheet sensor SE1 outputs the ON signals. Based on the length of the sheet S obtained from the second sheet sensor SE 2 and the counted value obtained from the first sensor SE1 and the timer, the controller 250 may obtain the sheet-conveying velocity V by the heat applier 81 and the pressure roller 82.

While an image is being formed on the sheet S, a rotating velocity of the first motor M1 may be fixed at a constant rate; however, the sheet-conveying velocity by the heat applier 81 and the pressure roller 82 may vary due to, for example, thermal expansion. While the roller body 82B in the pressure roller 82 may be a rubber roller which is resiliently deformable, when the pressure roller 82 accumulates the heat from the heat applier 81, the roller body 82B may expand, and the outer diameter of the roller body 82B may increase. According to the present embodiment, the driving force from the first motor M1 rotating at the constant rotating velocity is input to the pressure roller 82 to rotate the pressure roller 82; therefore, expansion of the outer diameter of the roller body 82B may increase the sheet-conveying velocity to convey the sheet S in the fuser 8 by the heat applier 81 and the pressure roller 82.

In this regard, when the sheet-conveying velocity V by the heat applier 81 and the pressure roller 82 is higher than or equal to a predetermined velocity V1, the controller 250 sets a rotating velocity VR of the second motor M2 at a first rotating velocity VR1 to set the circumferential velocity of the ejection roller 23 at a first velocity V3. Meanwhile, when the sheet-conveying velocity V by the heat applier 81 and the pressure roller 82 is lower than the predetermined velocity V1, the controller 250 sets the rotating velocity VR of the second motor M2 at a second rotating velocity VR2, which is lower than the first rotating velocity VR1, to set the circumferential velocity of the ejection roller 23 at a second velocity V2, which is lower than the first velocity V3. In this regard, the first velocity V3 and the second velocity V2 are higher than the sheet-conveying velocity V to convey the sheet S by the heat applier 81 and the pressure roller 8.

Figure 3:
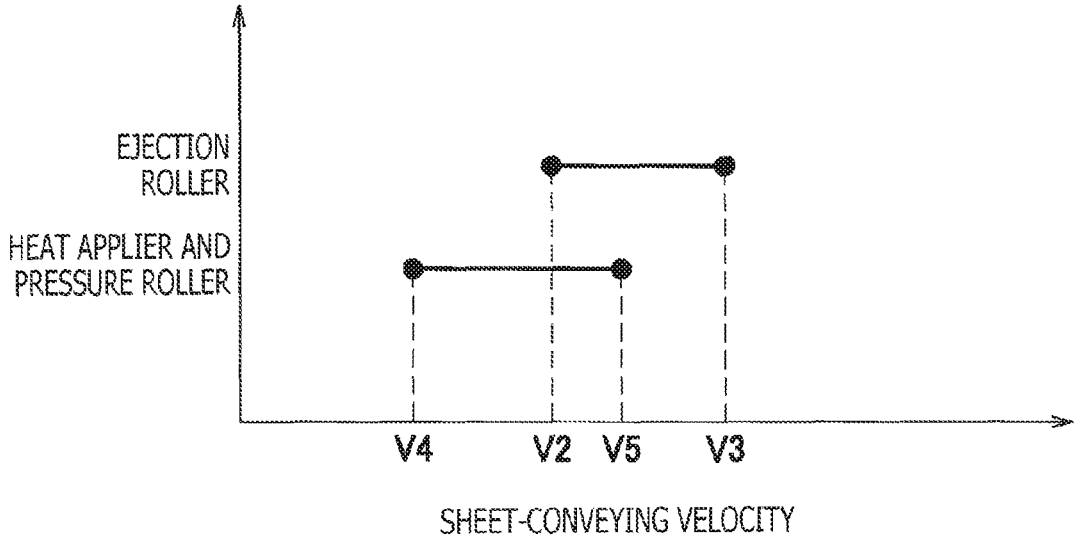
FIG. 3 is a graph to illustrate a variation range of a sheet-conveying velocity by a heat applier and a pressure roller to convey a sheet and a variation range of a circumferential velocity of an ejection roller in the laser printer according to the exemplary embodiment of the present disclosure.

As shown in FIG. 3, the second velocity V2 is lower than a maximum sheet-conveying velocity V5 for the heat applier 81 and the pressure roller 82 to convey the sheet S and higher than a minimum sheet-conveying velocity V4 for the heat applier 81 and the pressure roller 82 to convey the sheet S. Meanwhile, the first velocity V3 is higher than the maximum sheet-conveying velocity V5 for the heat applier 81 and the pressure roller 82 to convey the sheet S. In other words, a circumferential velocity range for the ejection roller 23, which is between the second velocity V2 and the first velocity V3, partly overlaps a sheet-conveying velocity range for the heat applier 81 and the pressure roller 82 to convey the sheet S, which is between the minimum sheet-conveying velocity V4 and the maximum sheet-conveying velocity V5.

Next, a flow of steps to control the behaviors of the second motor M and the switcher device 230 will be described below with reference to FIGS. 4 and 5.

Figure 4:
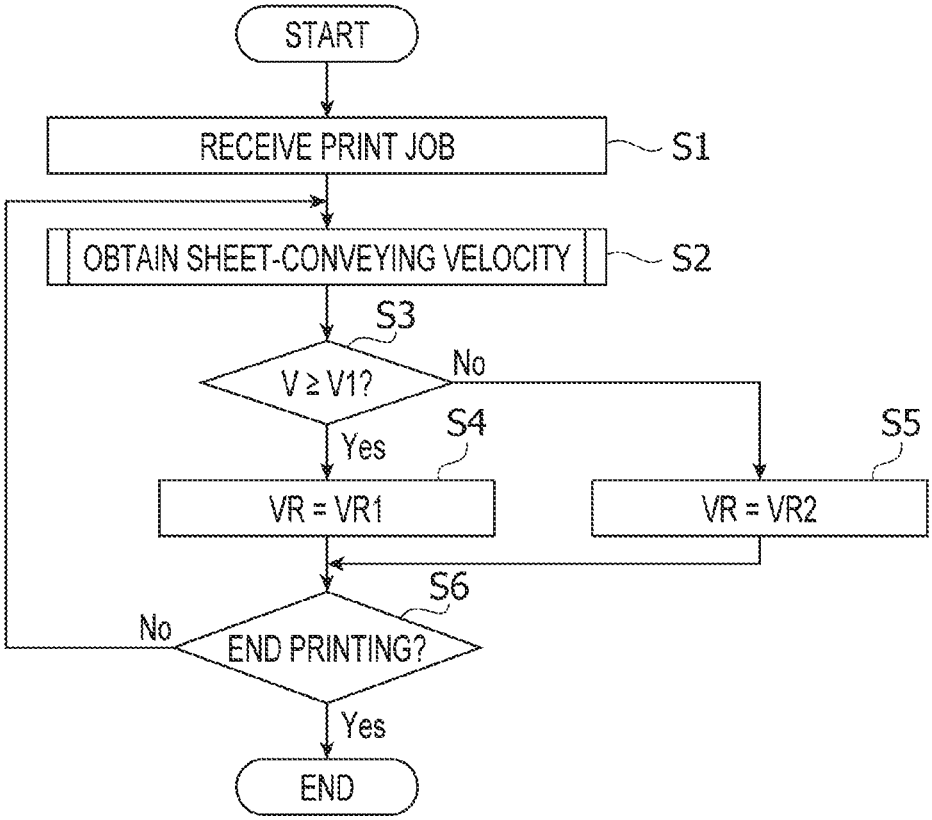
FIG. 4 is a flowchart to illustrate a controlling flow in an image forming operation to be conducted by a controller in the laser printer according to the exemplary embodiment of the present disclosure.

As shown in FIG. 4, in S1, when the controller 250 receives a print job, in S2, the controller 250 conducts a sheet-conveying velocity obtaining process to obtain the sheet-conveying velocity.

Figure 5:
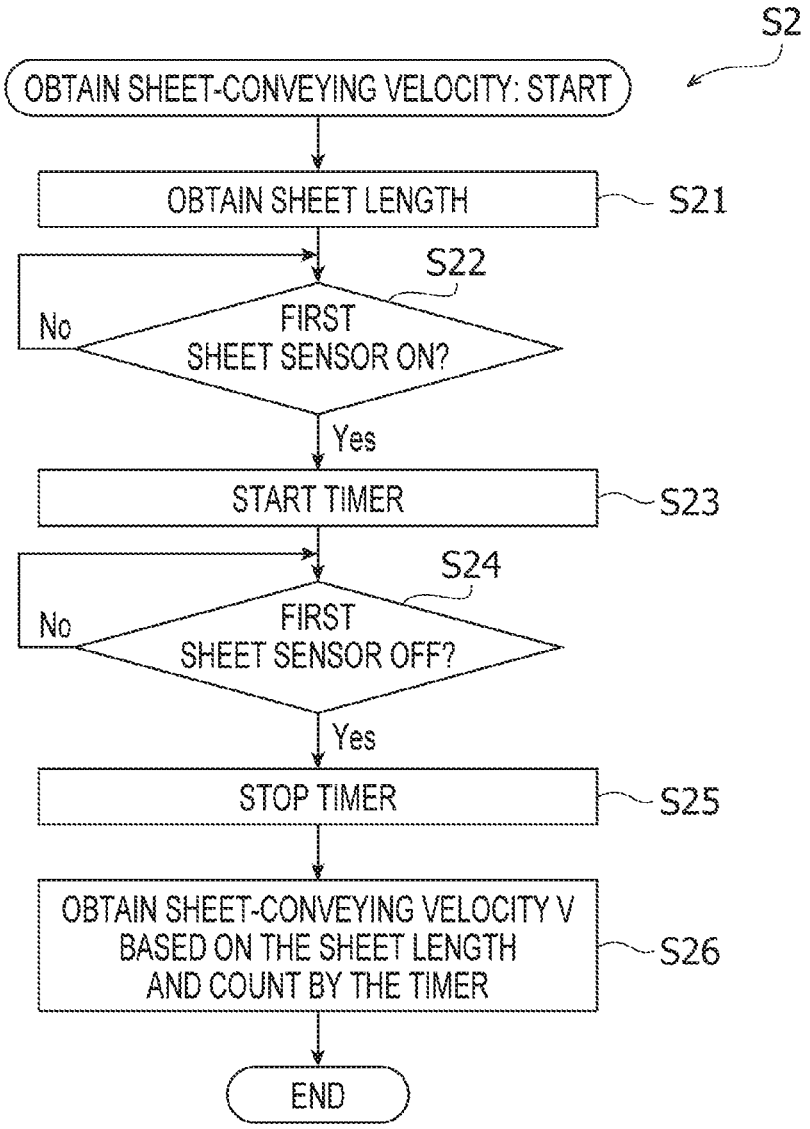
FIG. 5 is a flowchart to illustrate a controlling flow to obtain a sheet-conveying velocity conducted by the controller in the laser printer according to the exemplary embodiment of the present disclosure.

As shown in FIG. 5, in the sheet-conveying velocity obtaining process, in S21, the controller 250 obtains the length of the sheet S based on the detected results from the second sheet sensor SE2. Following S21, in S22, the controller 250 determines whether the first sheet sensor SE1 is outputting ON signals.

In S22, when the controller 250 determines that the first sheet sensor SE1 is not outputting ON signals (S22: NO), the controller 250 waits for ON signals from the first sheet sensor SE1.

In S22, when the controller 250 determines that the first sheet sensor SE1 is outputting ON signals (S22: YES), in S23, the controller 250 starts the timer. In S24, the controller 250 determines whether the first sheet sensor SE1 is outputting OFF signals.

In S24, when the controller 250 determines that the first sheet sensor SE1 is outputting no OFF signal but is outputting ON signals (S24: NO), the controller 250 waits for OFF signals from the first sheet sensor SE1.

In S24, when the controller 250 determines that the first sheet sensor SE1 is outputting OFF signals (S24: YES), in S25, the controller 250 stops the timer.

In S26, the controller 250 obtains the sheet-conveying velocity V conveying the sheet S by the heat applier 81 and the pressure roller 82 based on the length of the sheet S obtained in S21 and the duration counted by the timer. Thereafter, the controller 250 ends the sheet-conveying velocity obtaining process.

After the sheet-conveying velocity obtaining process, the controller 250 proceeds to S3 shown in FIG. 4. In S3, the controller 250 determines whether the obtained sheet-conveying velocity V is at the predetermined velocity V1 or higher.

When the controller 250 determines that the obtained sheet-conveying velocity V is at the predetermined velocity V1 or higher (S3: YES), in S4, the controller 250 sets the rotating velocity VR for the second motor M2 at the first rotating velocity VR1.

On the other hand, when the controller 250 determines that the obtained sheet-conveying velocity V is not higher than or equal to the predetermined velocity V1 but is lower than the predetermined velocity V1 (S3: NO), in S5, the controller 250 sets the rotating velocity VR for the second motor M2 at the second rotating velocity VR2.

Following S3 or S4, after switching the rotating velocity VR of the second motor M2 to the first rotating velocity VR1 or the second rotating velocity VR2, in S6, the controller 250 determines whether the print job is completed.

In S6, when the controller 250 determines that the print job is not completed (S6: NO), the controller 250 returns to S2 and continues the print job. Meanwhile, in S6, when the controller 250 determines that the print job is completed (S6: YES), the controller 250 ends the process.

Below include benefits achievable by the laser printer 1 configured as above.

According to the embodiment described above, the pressure roller 82, the conveyer roller 24, and the ejection roller 23 may be driven upon entry of a print job in the laser printer 1. Specifically, the ejection roller 23 is rotated at the higher circumferential velocity than the sheet-conveying velocity to convey the sheet S by the heat applier 81 and the pressure roller 82.

The sheet S conveyed through and exiting the fuser 8 may contact the guiding face 25A of the guide member 25 and curve with the leading end thereof directed upward. In this condition, the sheet S is arranged to have a surface thereof that faces the pressure roller 82 toward the guiding face 25A.

While the sheet S is being conveyed by the heat applier 81 and the pressure roller 82 in the fuser 8, and by the ejection roller 23, with the circumferential velocity of the ejection roller 23 being higher than the sheet-conveying velocity by the heat applier 81 and the pressure roller 82, the sheet S may be pulled by the ejection roller 23 to be conveyed in the conveyer path 91. Therefore, the sheet S may be prevented from being loosened largely between the fuser 8 and the ejection roller 23. In this regard, even with an image formed on the side of the sheet S that faces the pressure roller 82, the surface may be prevented from colliding with the guiding face 25A. In other words, the image on the side that faces the guiding face 25A may be prevented from being rubbed or ruined by the guiding face 25A while being conveyed in the conveyer path 91.

Meanwhile, the sheet-conveying velocity to convey the sheet S by the heat applier 81 and the pressure roller 82 may vary due to, for example, deformation or expansion of the roller body 82B in the pressure roller 82. In this regard, according to the present embodiment, when the sheet-conveying velocity V by the heat applier 81 and the pressure roller 82 is lower than the predetermined velocity V1, the driving force from the second motor M2 rotating at the second rotating velocity VR2 is transmitted to the ejection roller 23 through the transmission gear 240. Therefore, the ejection roller 23 may rotate at the second circumferential velocity V2. Meanwhile, when the sheet-conveying velocity V by the heat applier 81 and the pressure roller 82 is higher than or equal to the predetermined velocity V1, the driving force from the second motor M2 rotating at the first rotating velocity VR1 higher than the second rotating velocity VR2 is transmitted to the ejection roller 23 through the transmission gear 240. Therefore, the ejection roller 23 may rotate at the first circumferential velocity V3 higher than the second velocity V2.

In other words, in the laser printer 1 according to the embodiment, the higher the sheet-conveying velocity by the heat applier 81 and the pressure roller 82 is, the higher the circumferential velocity of the ejection roller 23 is increased to. Therefore, relation between the sheet-conveying velocity by the heat applier 81 and the pressure roller 82 and the circumferential velocity of the ejection roller 23 may not largely vary but may be maintained in balance so that the behavior of the sheet S conveyed through the fuser 8 may be stabilized.

According to the present embodiment, further, the sheet-conveying velocity V by the heat applier 81 and the pressure roller 82 is obtained based on the length of the sheet S detected by the second sheet sensor SE2 and the duration of the presence of the sheet S detected by the first sheet sensor SE1. In this respect, the first sheet sensor SE1 is disposed between the fuser 8, or more specifically the location of the heat applier 81 and the pressure roller 82, and the conveyer roller 24. Therefore, the sheet S may be detected at a range where the sheet S is conveyed stably so that the sheet-conveying velocity V by the heat applier 81 and the pressure roller 82 may be achieved accurately.

Although an example of carrying out the invention has been described, those skilled in the art will appreciate that there are numerous variations and permutations of the image forming apparatus and the controlling method that fall within the spirit and scope of the invention as set forth in the appended claims. For example, the flow of control or the method to obtain the sheet-conveying velocity V to convey the sheet S by the heat applier 81 and the pressure roller 82 may not necessarily be obtained with reference to the leading end and trailing end of the sheet S detected by the first sheet sensor SE1 but may be modified into those described below and shown in FIGS. 6-7. In the following description, items, structures, and steps in the flows, which are identical or equivalent to those described in the previous embodiment may be referred to by the same reference signs, and explanation of those will be omitted.

Figure 6:
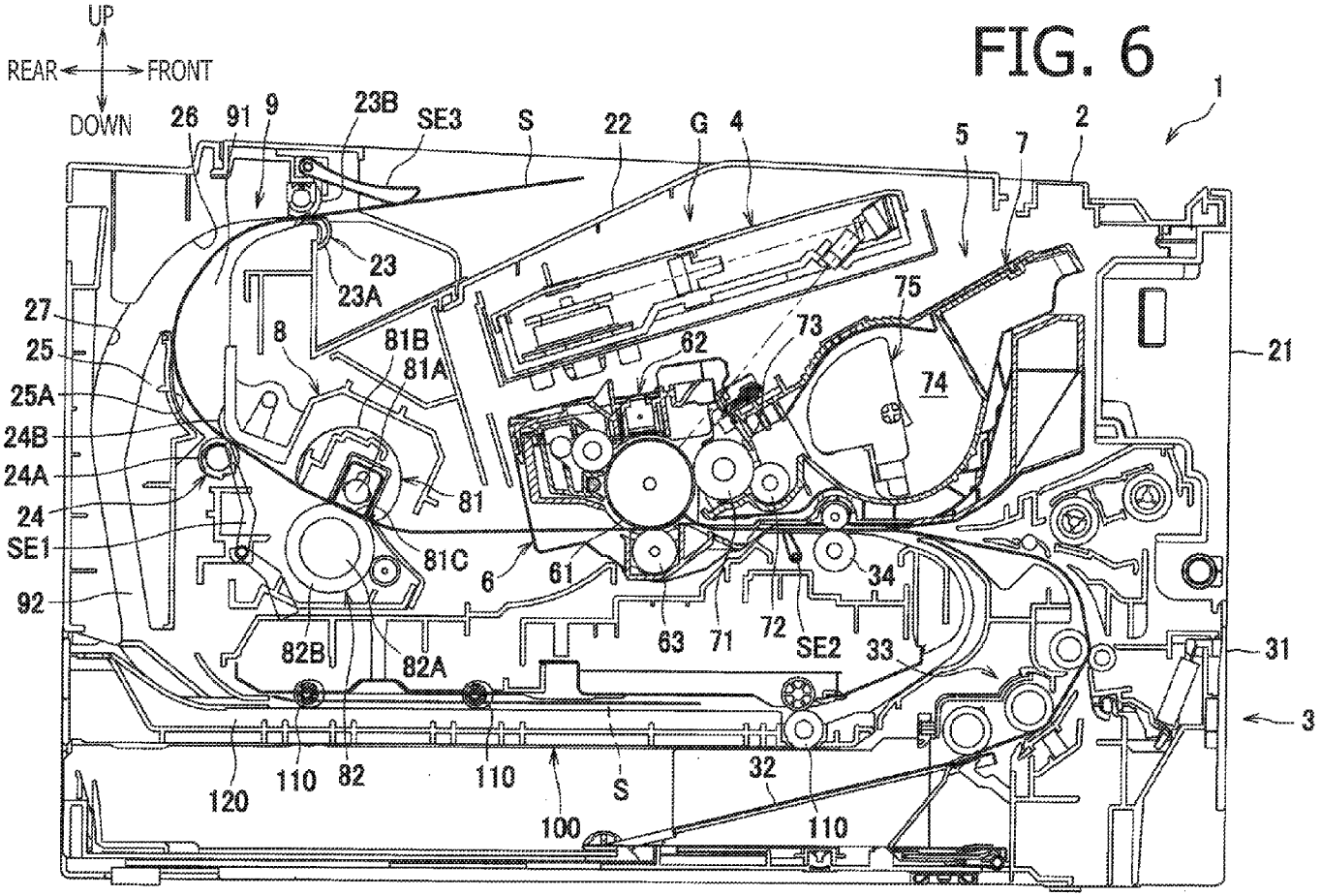
FIG. 6 is an illustrative cross-sectional side view of the laser printer with a sheet ejection sensor according to an exemplary embodiment of the present disclosure.

For example, as shown in FIG. 6, the laser printer 1 may have a sheet ejection sensor SE3 disposed at a downstream position with respect to the ejection roller 23 with regard to the forward direction to convey and eject the sheet S. The controller 250 may obtain the sheet-conveying velocity to convey the sheet S by the heat applier 81 and the pressure roller 82 based on the detected result from the first sheet sensor SE1 and a detected result from the sheet ejection sensor SE3.

The sheet ejection sensor SE3 may output ON signals when the sheet S being conveyed by the ejection roller 23 contacts the sheet ejection sensor SE3 and when the ejected sheets S are stacked on the ejection tray 22 to a predetermined height or higher. The controller 250 may obtain the sheet-conveying velocity to convey the sheet S by the heat applier 81 and the pressure roller 82 based on the length of the sheet S obtained through the first sheet sensor SE1 and a duration, which starts when the first sheet sensor SE1 detects the leading end of the sheet S and ends when the sheet ejection sensor SE3 detests the leading end of the sheet S.

For another example, the rotating velocity VR of the second motor M2 may not necessarily be switched between the two-leveled velocities, which are the first rotating velocity VR1 and the second rotating velocity VR2, but may be switched within multiple stages set between the first rotating velocity VR1 and the second rotating velocity VR2, or may be shifted continuously between the first rotating velocity VR1 and the second rotating velocity VR2 so that the circumferential velocity of the ejection roller 23 may be set at a rate between the second velocity V2 and the first velocity 2.

For another example, the driving unit 200 may not necessarily control the second motor M2 to change the circumferential velocity of the ejection roller 23 but may change the circumferential velocity of the ejection roller 23 without changing the rotating velocity of the motor that drives the ejection roller 23.

Figure 7:
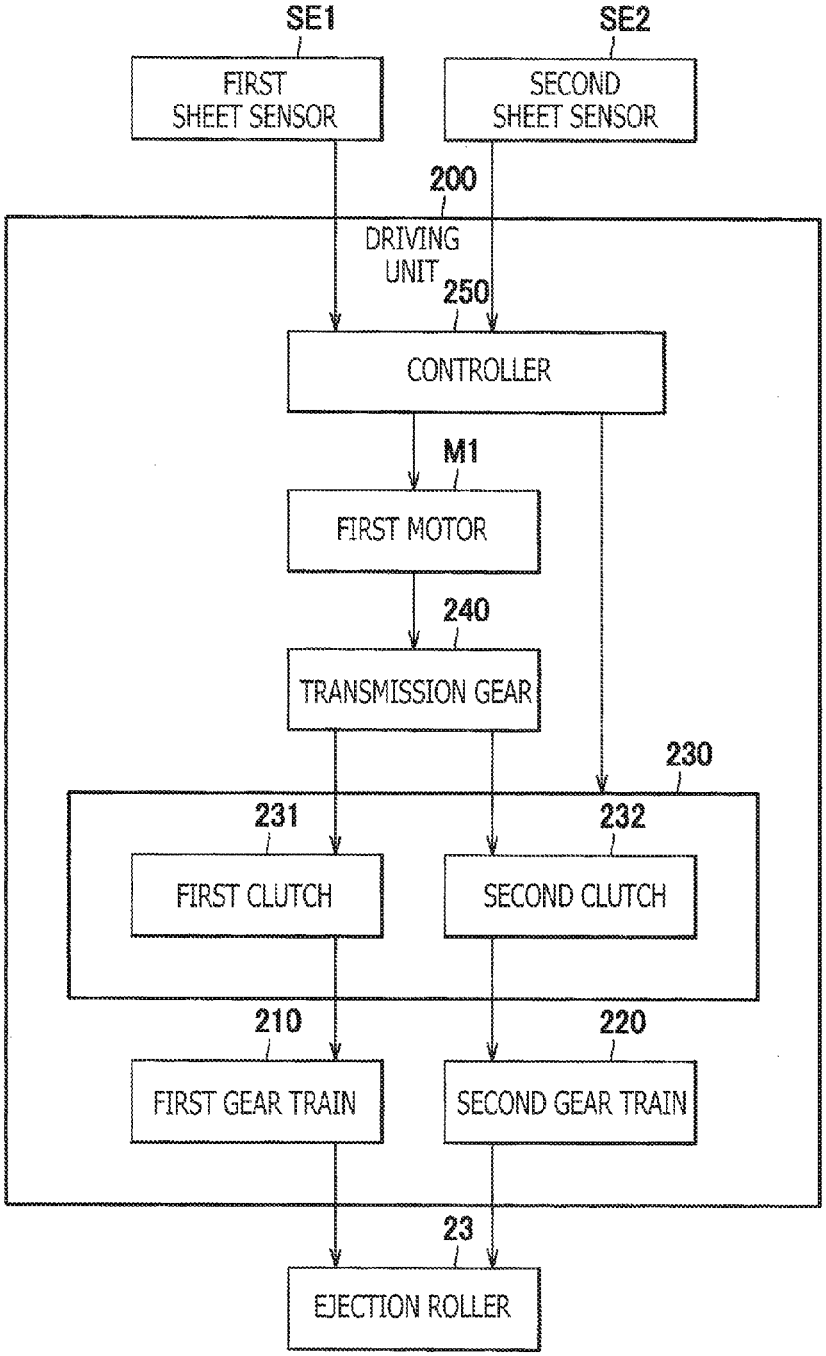
FIG. 7 is a diagram to illustrate a configuration of a switcher device in the laser printer according to the exemplary embodiment of the present disclosure.

Specifically, as shown in FIG. 7, the driving unit 200 may not be equipped with the second motor M2 but may have, in addition to the controller 250 and the transmission gear 240, the first motor M1 to drive the fuser 8, a first gear train 210, a second gear train 220, and a switcher device 230.

The first gear train 210 and the second gear train 220 each includes a plurality of gears to transmit the driving force from the first motor M1 to the first ejection roller 23A in the ejection roller 23. The first ejection roller 23A may be rotated at a higher circumferential velocity when the driving force from the first motor M1 is transmitted through the first gear train 210 than when the driving force from the first motor M1 is transmitted through the second gear train 220.

The switcher device 230 may switch transmission paths to transmit the driving force from the first motor M1 to the ejection roller 23 between the first gear train 210 and the second gear train 220. The switcher device 230 may include a first clutch 231 and a second clutch 232 being electromagnetic clutches.

The first clutch 231 may be connected with the first gear train 210 and may be switchable between an ON state, in which the first clutch 231 may transmit the driving force from the first motor M1 to the first gear train 210, and an OFF state, in which the first clutch 231 may disconnect the driving force from the first motor M1.

The second clutch 232 may be connected with the second gear train 220 and may be switchable between an ON state, in which the second clutch 232 may transmit the driving force from the first motor M1 to the second gear train 220, and an OFF state, in which the second clutch 232 may disconnect the driving force from the first motor M1.

The transmission gear 240 may be driven by the driving force from the first motor M1 and may be connected with either the first clutch 231 or the second clutch 232.

The controller 230 may place the first clutch 231 in the ON state and the second clutch 232 in the OFF state when the sheet-conveying velocity V by the heat applier 81 and the pressure roller 82 is higher than or equal to the predetermined velocity V1 so that the circumferential velocity of the ejection roller 23 may be set at the first velocity V3. On the other hand, the controller 230 may place the first clutch 231 in the OFF state and the second clutch 232 in the ON state when the sheet-conveying velocity V by the heat applier 81 and the pressure roller 82 is lower than the predetermined velocity V1 so that the circumferential velocity of the ejection roller 23 may be set at the first velocity V2.

Thus, the driving unit 200 configured as above may change the circumferential velocities of the ejection roller 23 with a single motor that may rotate at a constant velocity.

It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. An image forming apparatus, comprising:

a process unit configured to form a developer image on a sheet;

a fuser configured to convey the sheet and fix the developer image formed on the sheet;

a first roller configured to convey the sheet exiting the fuser to be ejected outside a body of the image forming apparatus;

a second roller configured to convey the sheet exiting the fuser, the second roller being disposed between the fuser and the first roller;

a first sensor disposed between the fuser and the second roller to detect the sheet; and a second sensor disposed at a position downstream from the first roller with regard to a sheet-conveying direction to detect the sheet; and a driving unit configured to drive the first roller, wherein the driving unit drives the first roller at a circumferential velocity higher than a sheet-conveying velocity of the fuser, the driving unit increasing the circumferential velocity of the first roller to be higher as the sheet-conveying velocity of the fuser increases, and wherein the driving unit obtains the sheet-conveying velocity of the fuser by detecting a leading end of the sheet by the first sensor and by the second sensor.

2. The image forming apparatus according to claim 1, wherein a range for the circumferential velocity of the first roller overlaps at least partly a range for the sheet-conveying velocity of the fuser.

3. The image forming apparatus according to claim 1, further comprising:

a guide disposed between the fuser and the first roller;

wherein the fuser comprises a first surface and a second surface facing each other to convey the sheet therebetween, the first surface being configured to contact a first face of the sheet, on which the developer image is formed, a second face of the sheet being an opposite face from the first face of the sheet; and wherein the guide comprises a guiding face arranged to contact the second face of the sheet exiting the fuser to curve the sheet toward a side of the first surface.

4. The image forming apparatus according to claim 1, wherein a circumferential velocity of the second roller is higher than the sheet-conveying velocity of the fuser; and wherein a frictional force produced between the second roller and the sheet is smaller than a frictional force produced between the fuser and the sheet.

5. The image forming apparatus according to claim 1, wherein the first roller is configured to convey the sheet exiting the fuser in a forward direction by rotating in a forward rotating direction and to convey the sheet exiting the fuser in a reverse direction opposite from the forward direction by rotating in a reverse rotating direction opposite from the forward rotating direction.

6. The image forming apparatus according to claim 1, further comprising:

a first motor configured to produce a driving force to drive the fuser to convey the sheet and a second motor configured to produce a driving force to drive the first roller to convey the sheet, wherein the driving unit increases a rotating velocity of the second motor to increase the circumferential velocity of the first roller.

7. The image forming apparatus according to claim 6, wherein the fuser comprises a pressure roller which is resiliently deformable, the pressure roller being arranged to contact a face of the sheet opposite from a developing face on which the developer image to be fixed in the fuser is formed; and wherein the driving force from the first motor rotating at a constant rotating velocity is input to the pressure roller to rotate the pressure roller.

8. An image forming apparatus, comprising:

a process unit configured to form a developer image on a sheet;

a fuser configured to convey the sheet and fix the developer image formed on the sheet;

a first roller configured to convey the sheet exiting the fuser to be ejected outside a body of the image forming apparatus;

a driving unit configured to drive the first roller, a first motor configured to produce a driving force to drive the fuser to convey the sheet; and a first gear train and a second gear train configured to each transmit the driving force from the first motor to the first roller, the first gear train transmitting the driving force to the first roller to rotate the first roller at a circumferential velocity higher than a circumferential velocity of the first roller driven by the driving force transmitted through the second gear train, wherein the driving unit drives the first roller at a circumferential velocity higher than a sheet-conveying velocity of the fuser, the driving unit increasing the circumferential velocity of the first roller to be higher as the sheet-conveying velocity of the fuser increases, and wherein the driving unit drives the first roller by the driving force from the first motor transmitted through the first gear train when the sheet-conveying velocity of the fuser is one of higher than and equal to a predetermined velocity, and by the driving force from the first motor transmitted through the second gear train when the sheet-conveying velocity of the fuser is lower than the predetermined velocity.

9. The image forming apparatus according to claim 8, wherein a range for the circumferential velocity of the first roller overlaps at least partly a range for the sheet-conveying velocity of the fuser.

10. The image forming apparatus according to claim 8, further comprising:

a guide disposed between the fuser and the first roller;

wherein the fuser comprises a first surface and a second surface facing each other to convey the sheet therebetween, the first surface being configured to contact a first face of the sheet, on which the developer image is formed, a second face of the sheet being an opposite face from the first face of the sheet; and wherein the guide comprises a guiding face arranged to contact the second face of the sheet exiting the fuser to curve the sheet toward a side of the first surface.

11. The image forming apparatus according to claim 8, further comprising a second roller configured to convey the sheet exiting the fuser, the second roller being disposed between the fuser and the first roller.

12. The image forming apparatus according to claim 11, wherein a circumferential velocity of the second roller is higher than the sheet-conveying velocity of the fuser; and wherein a frictional force produced between the second roller and the sheet is smaller than a frictional force produced between the fuser and the sheet.

13. The image forming apparatus according to claim 11, further comprising:

a first sensor disposed between the fuser and the second roller to detect the sheet, wherein the driving unit obtains the sheet-conveying velocity of the fuser by detecting a leading end and a trailing end of the sheet by the first sensor.

14. The image forming apparatus according to claim 11, further comprising:

a first sensor disposed between the fuser and the second roller to detect the sheet; and a second sensor disposed at a position downstream from the first roller with regard to a sheet-conveying direction to detect the sheet, wherein the driving unit obtains the sheet-conveying velocity of the fuser by detecting a leading end of the sheet by the first sensor and by the second sensor.

15. The image forming apparatus according to claim 8, wherein the first roller is configured to convey the sheet exiting the fuser in a forward direction by rotating in a forward rotating direction and to convey the sheet exiting the fuser in a reverse direction opposite from the forward direction by rotating in a reverse rotating direction opposite from the forward rotating direction.

16. An image forming apparatus, comprising:

a process unit configured to form a developer image on a sheet;

a fuser configured to convey the sheet and fix the developer image formed on the sheet;

a first roller configured to convey the sheet exiting the fuser to be ejected outside a body of the image forming apparatus;

a second roller configured to convey the sheet exiting the fuser, the second roller being disposed between the fuser and the first roller;

a first sensor disposed between the fuser and the second roller to detect the sheet;

a sheet feeder configured to feed the sheet to the process unit;

a second sensor disposed between the sheet feeder and the process unit to detect the sheet; and a driving unit configured to drive the first roller, wherein the driving unit drives the first roller at a circumferential velocity higher than a sheet-conveying velocity of the fuser, the driving unit increasing the circumferential velocity of the first roller to be higher as the sheet-conveying velocity of the fuser increases, wherein a circumferential velocity of the second roller is higher than the sheet-conveying velocity of the fuser, wherein a frictional force produced between the second roller and the sheet is smaller than a frictional force produced between the fuser and the sheet, and wherein the driving unit obtains the sheet-conveying velocity of the fuser by detecting a leading end and a trailing end of the sheet by the first sensor, and based on a length of the sheet obtained from the second sensor and a duration of presence of the sheet detected by the first sensor.

17. The image forming apparatus according to claim 16, wherein a range for the circumferential velocity of the first roller overlaps at least partly a range for the sheet-conveying velocity of the fuser.

18. The image forming apparatus according to claim 16, further comprising:

a guide disposed between the fuser and the first roller;

wherein the fuser comprises a first surface and a second surface facing each other to convey the sheet therebetween, the first surface being configured to contact a first face of the sheet, on which the developer image is formed, a second face of the sheet being an opposite face from the first face of the sheet; and wherein the guide comprises a guiding face arranged to contact the second face of the sheet exiting the fuser to curve the sheet toward a side of the first surface.

* * * * *